US008289312B2

(12) United States Patent
Matsuda et al.

(10) Patent No.: US 8,289,312 B2
(45) Date of Patent: Oct. 16, 2012

(54) LIQUID CRYSTAL DISPLAY DEVICE

(75) Inventors: Noriko Matsuda, Osaka (JP); Atsuhito Murai, Osaka (JP); Masaki Uehata, Osaka (JP); Takashi Kurihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 244 days.

(21) Appl. No.: 12/451,376

(22) PCT Filed: Dec. 7, 2007

(86) PCT No.: PCT/JP2007/073704
§ 371 (c)(1),
(2), (4) Date: Dec. 29, 2009

(87) PCT Pub. No.: WO2008/139656
PCT Pub. Date: Nov. 20, 2008

(65) Prior Publication Data

US 2010/0134473 A1 Jun. 3, 2010

(30) Foreign Application Priority Data

May 11, 2007 (JP) ..... 2007 126883

(51) Int. Cl.
*G09G 3/36* (2006.01)

(52) U.S. Cl. ..... 345/213; 345/94

(58) Field of Classification Search ..... 345/87–104, 345/204–206, 209–210, 212–213; 349/42, 349/46, 47
See application file for complete search history.

(56) References Cited

U.S. PATENT DOCUMENTS

| | | | | |
|---|---|---|---|---|
| 5,892,494 | A * | 4/1999 | Kimura et al. | 345/96 |
| 6,456,268 | B1 | 9/2002 | Takeda | |
| 7,362,321 | B2 * | 4/2008 | Kumada et al. | 345/209 |
| 7,907,106 | B2 * | 3/2011 | Shin et al. | 345/87 |
| 2002/0041281 | A1 | 4/2002 | Yanagi et al. | |
| 2004/0041778 | A1 | 3/2004 | Hiracki et al. | |

FOREIGN PATENT DOCUMENTS

| | | |
|---|---|---|
| JP | 2001-013930 | 1/2001 |
| JP | 2002-116739 | 4/2002 |
| JP | 2004-086146 | 3/2004 |

* cited by examiner

*Primary Examiner* — Amare Mengistu
*Assistant Examiner* — Stacy Khoo
(74) *Attorney, Agent, or Firm* — Harness, Dickey & Pierce, P.L.C.

(57) ABSTRACT

In a liquid crystal display device performing alternating-current driving, at least one of a gate voltage amplitude Vgp–p(p) upon application of a positive polarity voltage and a gate voltage amplitude Vgp–p(n) upon application of a negative polarity voltage is changed in accordance with a liquid crystal driving frequency. Thus, an effective value of a liquid crystal application voltage in a positive polarity is set to be equal to an effective value of a liquid crystal application voltage in a negative polarity irrespective of the liquid crystal driving frequency, so that flicker is prevented from occurring when the liquid crystal driving frequency is switched. As the liquid crystal driving frequency is low, a gate low voltage Vgln after application of the negative polarity voltage is set to be low. Thus, a leak current from a TFT is reduced in the negative polarity, and a liquid crystal element is improved in voltage holding ratio.

11 Claims, 7 Drawing Sheets

*Fig. 2*
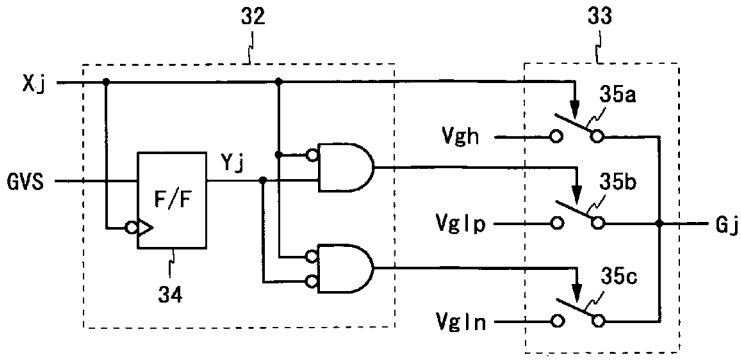
*Fig. 3*
| Xj | Yj | Gj |
|---|---|---|
| H | — | Vgh |
| L | H | Vglp |
| L | L | Vgln |
*Fig. 4*
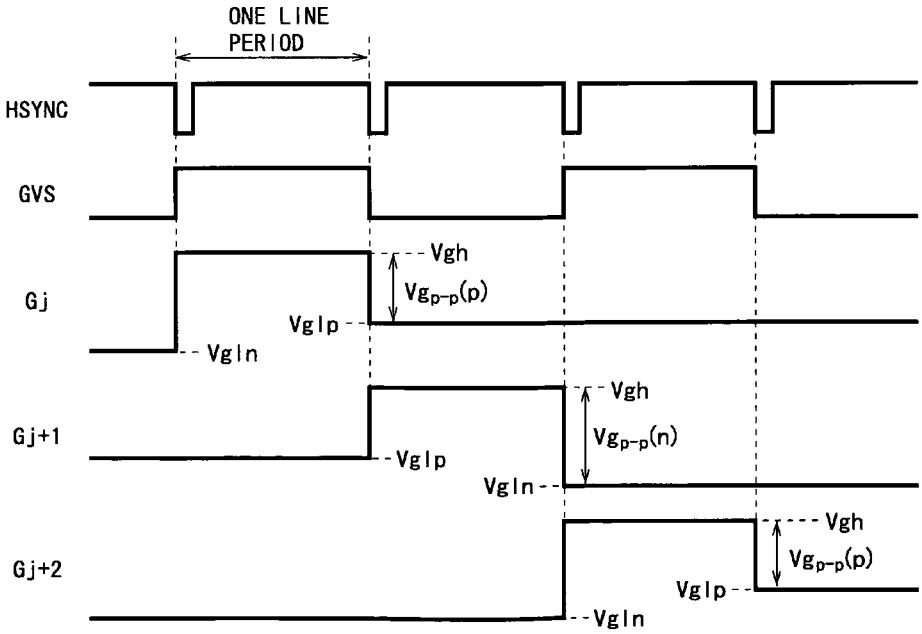

LIQUID CRYSTAL DISPLAY DEVICE

TECHNICAL FIELD

The present invention relates to a liquid crystal display device, and more particularly relates to a liquid crystal display device having a function of switching a liquid crystal driving frequency.

BACKGROUND ART

A liquid crystal display device is used in various electronic appliances such as a television receiver and a personal computer. Generally, it is preferred that a liquid crystal display device is low in power consumption. In particular, a liquid crystal display device used in portable electronic appliances (e.g., a mobile telephone, a handheld computer) is strongly requested to achieve low power consumption.

As one of methods for reducing power consumption in a liquid crystal display device, there has been known a method for switching a liquid crystal driving frequency. For example, in a case where a liquid crystal display device is used in a handheld computer, when a state in which the handheld computer receives no manipulation input from a user continues for a predetermined time or more, a liquid crystal driving frequency may be set to be lower than that in a normal state. When the liquid crystal driving frequency is set to be low, power consumption is reduced considerably although a cycle of updating a screen becomes long.

On the other hand, a liquid crystal has a characteristic in that degradation takes place in a short time by application of a direct-current voltage. For this reason, the liquid crystal display device performs alternating-current driving for switching a polarity of a liquid crystal application voltage at every predetermined cycle. Moreover, when an effective value of the liquid crystal application voltage upon application of a positive polarity voltage (hereinafter, referred to as "in a positive polarity") is different from an effective value of the liquid crystal application voltage upon application of a negative polarity voltage (hereinafter, referred to as "in a negative polarity"), flicker occurs at the screen. In order to prevent this flicker, a process of adjusting a voltage to be applied to a common electrode (hereinafter, referred to as a common voltage Vcom) is performed to set the effective value of the liquid crystal application voltage in the positive polarity to be equal to the effective value of the liquid crystal application voltage in the negative polarity.

With reference to FIGS. 10 and 11, description will be given of the adjustment of the common voltage Vcom. FIG. 10 is an equivalent circuit diagram of a pixel circuit included in a liquid crystal display device. In the pixel circuit 11 shown in FIG. 10, a TFT (Thin Film Transistor) 12 has a gate terminal connected to a gate line Gj, a source terminal connected to a source line Si, and a drain terminal connected to a first electrode of a liquid crystal capacitor 13 and a first electrode of an auxiliary capacitor 14. The common voltage Vcom is applied to a second electrode of the liquid crystal capacitor 13, and an auxiliary voltage Vcs is applied to a second electrode of the auxiliary capacitor 14.

FIG. 11 is a signal waveform chart showing change of terminal voltages of the TFT 12. In order to write a voltage in accordance with display data to the pixel circuit 11, a high-level voltage Vgh is applied to the gate line Gj, and a positive polarity voltage or a negative polarity voltage, both in accordance with the display data, is applied to the source line Si.

When a gate voltage Vg turns into Vgh, the TFT 12 turns into an ON state, so that a drain voltage Vd becomes equal to a source voltage Vs.

Thereafter, when a low-level voltage Vgl is applied to the gate line Gj, the TFT 12 turns into an OFF state. Since a parasitic capacitor is provided between the gate and the drain of the TFT 12, when the gate voltage Vg changes from Vgh to Vgl, the drain voltage Vd drops by a predetermined amount. A drop amount ΔV in such a case is referred to as a pull-in voltage or a feed-through voltage, and is expressed by the following equation (1).

$$\Delta V = Vg_{p\text{-}p} \times Cgd/(Clc+Ccs+Cgd) \quad (1)$$

In the equation (1), $Vg_{p\text{-}p}$ represents a gate voltage amplitude (=Vgh−Vgl), Clc represents a capacitance value of the liquid crystal capacitor 13, Ccs represents a capacitance value of the auxiliary capacitor 14, and Cgd represents a capacitance value of the parasitic capacitor between the gate and the drain of the TFT 12.

After the TFT 12 turns into the OFF state, a leak current flows through the TFT 12; therefore, the drain voltage Vd gradually rises or drops to approach the common voltage Vcom. This state continues until the high-level voltage Vgh is applied to the gate line Gj after one frame period.

In the pixel circuit 11, the liquid crystal capacitor 13 corresponds to a liquid crystal element. A transmittance of a liquid crystal panel is determined based on the effective value of the liquid crystal application voltage, that is, an effective value of a difference between the drain voltage Vd and the common voltage Vcom (a diagonally shaded portion in FIG. 11). Accordingly, the common voltage Vcom is adjusted such that an effective voltage Vrms(p) in the positive polarity becomes equal to an effective voltage Vrms(n) in the negative polarity. Thus, the transmittance of the liquid crystal panel in the positive polarity is set to be equal to the transmittance of the liquid crystal panel in the negative polarity, and a difference in luminance is eliminated. As a result, flicker can be prevented.

In relation to the present invention, Patent Document 1 describes a technique of changing a common voltage or a signal voltage in accordance with a length of a write holding time. Moreover, Patent Document 2 describes a technique of changing both a gate-on voltage and a common voltage in accordance with a horizontal synchronous frequency.

[Patent Document 1] Japanese Laid-Open Patent Publication No. 2002-116739

[Patent Document 2] Japanese Laid-Open Patent Publication No. 2001-13930

DISCLOSURE OF THE INVENTION

Problems to be Solved by the Invention

As described above, in order to prevent the flicker, the process of adjusting the common voltage Vcom is performed in the liquid crystal display device. Herein, the common voltage Vcom is adjusted such that the flicker becomes minimum when the screen is displayed at a specific liquid crystal driving frequency.

However, an off characteristic (an amount of leak current) in the positive polarity and an off characteristic in the negative polarity are different from each other in the TFT 12. Moreover, upper and lower substrates forming the liquid crystal capacitor 13 are different in characteristic from each other. In the liquid crystal element, therefore, the voltage holding ratio in the positive polarity and the voltage holding ratio in the negative polarity are different from each other. For this reason, even when the common voltage Vcom is adjusted such that the effective voltage in the positive polarity becomes equal to the effective voltage in the negative polarity at a certain liquid crystal driving frequency, both the effective voltages do not necessarily become equal to each other at a different liquid crystal driving frequency. Accordingly, when the liquid crystal driving frequency is switched, flicker occurs at the screen to degrade display quality. Moreover, when the liquid crystal driving frequency is switched, a direct-current voltage is applied to a liquid crystal, so that there arises a problem that the liquid crystal is degraded in a short time.

Patent Documents 1 and 2 describe the methods for preventing the flicker from occurring when the liquid crystal driving frequency is switched. According to these methods, however, the common voltage Vcom or the signal voltage is changed in accordance with the liquid crystal driving frequency. Consequently, it becomes difficult to perform a process of adjusting the common voltage Vcom or the signal voltage. In a liquid crystal display device that employs a direct-current voltage as a common voltage, particularly, when the common voltage Vcom is changed in accordance with a liquid crystal driving frequency, an effective value of a liquid crystal application voltage varies largely, resulting in change of brightness of a screen. Consequently, a signal voltage, which can not be adjusted with ease, must be changed in accordance with the liquid crystal driving frequency, in addition to the common voltage Vcom.

Hence, it is an object of the present invention to provide a liquid crystal display device that prevents flicker from occurring when a liquid crystal driving frequency is switched, by a method different from the conventional method.

Solutions to the Problems

A first aspect of the present invention has a feature in that a liquid crystal display device having a function of switching a liquid crystal driving frequency includes: a plurality of pixel circuits each including a liquid crystal element, the pixel circuits being arranged at intersections of a plurality of scanning signal lines and a plurality of data signal lines; a scanning signal line drive circuit for switching between a selection voltage and a non-selection voltage to apply the switched voltage to the scanning signal line; and a data signal line drive circuit for switching between a positive polarity voltage and a negative polarity voltage, both in accordance with display data, to apply the switched voltage to the data signal line, and herein, at least one of a difference between a first voltage corresponding to a selection voltage upon application of the positive polarity voltage and a second voltage corresponding to a non-selection voltage after application of the positive polarity voltage and a difference between a third voltage corresponding to a selection voltage upon application of the negative polarity voltage and a fourth voltage corresponding to a non-selection voltage after application of the negative polarity voltage changes in accordance with a driving frequency of the liquid crystal element.

A second aspect of the present invention has a feature in that, in the first aspect of the present invention, any one voltage among the first to fourth voltages changes in accordance with the driving frequency.

A third aspect of the present invention has a feature in that, in the first aspect of the present invention, a plurality of voltages among the first to fourth voltages change in accordance with the driving frequency.

A fourth aspect of the present invention has a feature in that, in the first aspect of the present invention, the third voltage is higher than the fourth voltage, and the difference between the third voltage and the fourth voltage becomes large as the driving frequency is low.

A fifth aspect of the present invention has a feature in that, in the fourth aspect of the present invention, the fourth voltage becomes low as the driving frequency is low.

A sixth aspect of the present invention has a feature in that, in the fourth aspect of the present invention, the third voltage becomes high as the driving frequency is low.

A seventh aspect of the present invention has a feature in that, in the first aspect of the present invention, the first voltage is higher than the second voltage, and the difference between the first voltage and the second voltage becomes large as the driving frequency is low.

An eighth aspect of the present invention has a feature in that, in the seventh aspect of the present invention, the second voltage becomes low as the driving frequency is low.

A ninth aspect of the present invention has a feature in that, in the seventh aspect of the present invention, the first voltage becomes high as the driving frequency is low.

A tenth aspect of the present invention has a feature in that, in the first aspect of the present invention, the liquid crystal display device further includes a voltage generation circuit for generating the selection voltage and the non-selection voltage to supply the generated voltage to the scanning signal line drive circuit, and herein, the voltage generation circuit separately supplies the first voltage and the third voltage, and/or the second voltage and the fourth voltage to the scanning signal line drive circuit.

An eleventh aspect of the present invention has a feature in that a method for driving a liquid crystal display device including a plurality of pixel circuits each including a liquid crystal element, the pixel circuits being arranged at intersections of a plurality of scanning signal lines and a plurality of data signal lines, includes the steps of: switching between a selection voltage and a non-selection voltage to apply the switched voltage to the scanning signal line; and switching between a positive polarity voltage and a negative polarity voltage, both in accordance with display data, to apply the switched voltage to the data signal line, and herein, at least one of a difference between a selection voltage upon application of the positive polarity voltage and a non-selection voltage after application of the positive polarity voltage and a difference between a selection voltage upon application of the negative polarity voltage and a non-selection voltage after application of the negative polarity voltage changes in accordance with a driving frequency of the liquid crystal element.

Effects of the Invention

According to the first or eleventh aspect of the present invention, at least one of the voltage amplitude on the scanning signal line in the positive polarity and the voltage amplitude on the scanning signal line in the negative polarity is changed in accordance with the driving frequency of the liquid crystal element. Therefore, it is possible to set an effective value of a liquid crystal application voltage in the positive polarity to be equal to an effective value of a liquid crystal application voltage in the negative polarity irrespective of the liquid crystal driving frequency, and to prevent flicker from occurring when the liquid crystal driving frequency is switched.

According to the second aspect of the present invention, in accordance with the driving frequency of the liquid crystal element, any one voltage among the first to fourth voltages changes, so that the voltage amplitude on the scanning signal line in the positive polarity or the voltage amplitude on the scanning signal line in the negative polarity changes. Accordingly, it is possible to prevent flicker from occurring when the liquid crystal driving frequency is switched, with the simple circuitry.

According to the third aspect of the present invention, in accordance with the driving frequency of the liquid crystal element, a plurality of voltages among the first to fourth voltages change, so that at least one of the voltage amplitude on the scanning signal line in the positive polarity and the voltage amplitude on the scanning signal line in the negative polarity changes. Accordingly, it is possible to set the effective value of the liquid crystal application voltage in the positive polarity to be equal to the effective value of the liquid crystal application voltage in the negative polarity with higher accuracy, and to more suitably prevent flicker from occurring when the liquid crystal driving frequency is switched.

According to the fourth aspect of the present invention, in the case where the selection voltage is higher than the non-selection voltage, the voltage amplitude on the scanning signal line in the negative polarity is set to be large as the driving frequency of the liquid crystal element is low. Accordingly, it is possible to set the effective value of the liquid crystal application voltage in the positive polarity to be equal to the effective value of the liquid crystal application voltage in the negative polarity irrespective of the liquid crystal driving frequency, and to prevent flicker from occurring when the liquid crystal driving frequency is switched.

According to the fifth aspect of the present invention, it is possible to prevent flicker from occurring when the liquid crystal driving frequency is switched, with the simple circuitry. Moreover, when the liquid crystal driving frequency is low, the non-selection voltage in the negative polarity is set to be low. Thus, it is possible to reduce a leak current from the transistor in the pixel circuit, and to improve a voltage holding ratio of the liquid crystal element.

According to the sixth aspect of the present invention, it is possible to prevent flicker from occurring when the liquid crystal driving frequency is switched, with the simple circuitry.

According to the seventh aspect of the present invention, in the case where the selection voltage is higher than the non-selection voltage, the voltage amplitude on the scanning signal line in the positive polarity is set to be large as the driving frequency of the liquid crystal element is low. Accordingly, it is possible to set the effective value of the liquid crystal application voltage in the positive polarity to be equal to the effective value of the liquid crystal application voltage in the negative polarity irrespective of the liquid crystal driving frequency, and to prevent flicker from occurring when the liquid crystal driving frequency is switched.

According to the eighth or ninth aspect of the present invention, it is possible to prevent flicker from occurring when the liquid crystal driving frequency is switched, with the simple circuitry.

According to the tenth aspect of the present invention, by use of a voltage to be supplied from the voltage generation circuit to the scanning signal line drive circuit, at least one of the voltage amplitude on the scanning signal line in the positive polarity and the voltage amplitude on the scanning signal line in the negative polarity is changed in accordance with the driving frequency of the liquid crystal element. Thus, it is possible to prevent flicker from occurring when the liquid crystal driving frequency is switched.

BRIEF DESCRIPTION OF THE DRAWINGS

FIG. 2 is a circuit diagram of a switch control circuit and a switch circuit included in the liquid crystal display device shown in FIG. 1.

FIG. 3 is a table showing a voltage at a gate line in the liquid crystal display device shown in FIG. 1.

FIG. 4 is a signal waveform chart showing change of the voltage at the gate line in the liquid crystal display device shown in FIG. 1.

DESCRIPTION OF REFERENCE SYMBOLS

Figure 1:
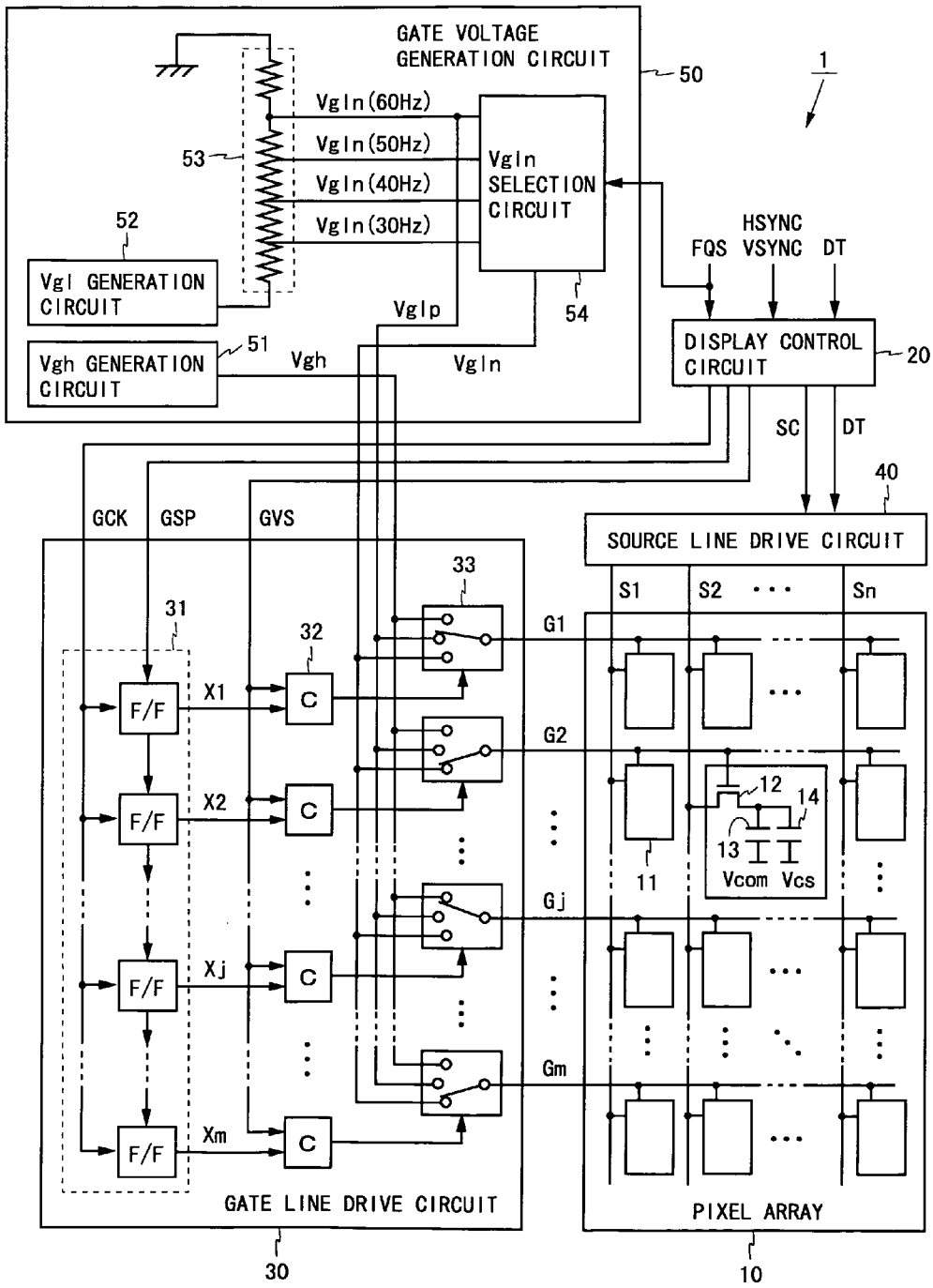
FIG. 1 is a block diagram showing a configuration of a liquid crystal display device according to one embodiment of the present invention.

1 Liquid crystal display device
10 Pixel array
11 Pixel circuit
12 TFT
13 Liquid crystal capacitor
14 Auxiliary capacitor
20 Display control circuit
30 Gate line drive circuit
31 Shift register
32 Switch control circuit
33 Switch circuit
34 Flip-flop
35 Analog switch
40 Source line drive circuit
50 Gate voltage generation circuit
51 Vgh generation circuit
52 Vgl generation circuit
53 Resistance division circuit
54 Vgln selection circuit
Vgh Gate high voltage
Vglp Gate low voltage in positive polarity
Vgln Gate low voltage in negative polarity
Vcom Common voltage

BEST MODE FOR CARRYING OUT THE INVENTION

FIG. 1 is a block diagram showing a configuration of a liquid crystal display device according to one embodiment of the present invention. The liquid crystal display device 1 shown in FIG. 1 includes a pixel array 10, a display control circuit 20, a gate line drive circuit 30, a source line drive circuit 40, and a gate voltage generation circuit 50. In the following, it is assumed that m and n each are an integer of one or more, at least one of m and n is an integer of two or more, and j is an integer in a range from one or more to m or less.

Figure 10:
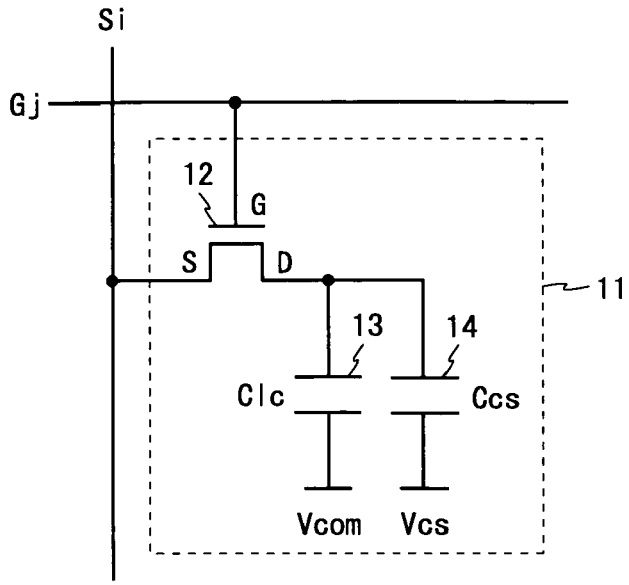
FIG. 10 is an equivalent circuit diagram of a pixel circuit included in a liquid crystal display device.
Figure 11:
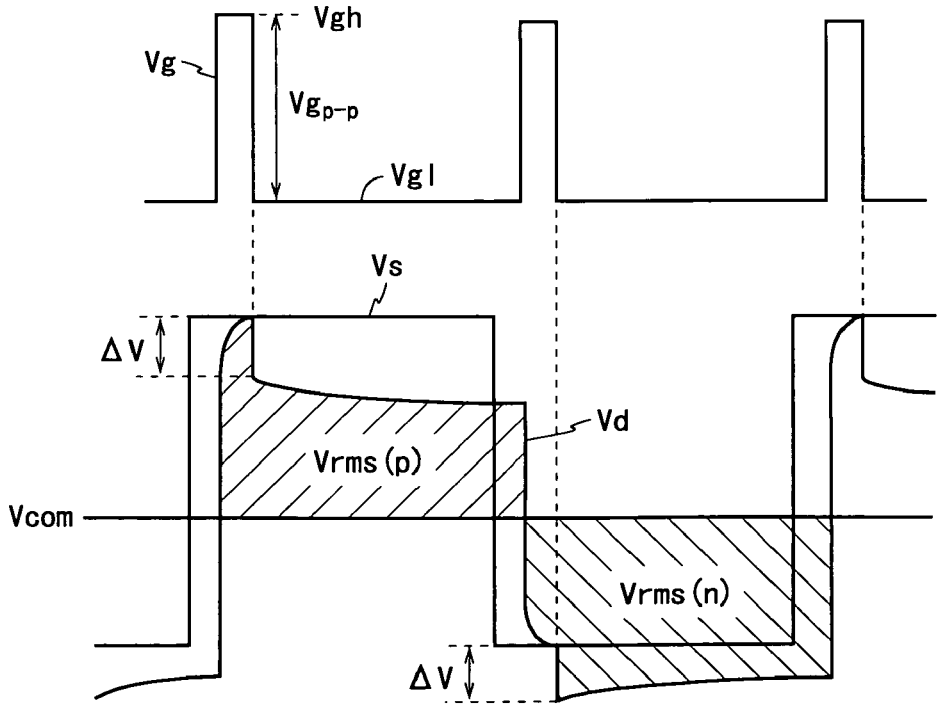
FIG. 11 is a signal waveform chart showing change of terminal voltages of a TFT included in the pixel circuit shown in FIG. 10.

The pixel array 10 includes m gate lines G1 to Gm, n source lines S1 to Sn, and (m×n) pixel circuits 11. The gate line is also referred to as a scanning signal line, and the source line is also referred to as a data signal line. The gate lines G1 to Gm are arranged in parallel with one another, and the source lines S1 to Sn are arranged in parallel with one another so as to be orthogonal to the gate lines G1 to Gm. The pixel circuits 11 are provided at intersections of the gate lines G1 to Gm and the source lines S1 to Sn. Each pixel circuit 11 is connected to one gate line and one source line. The pixel circuit 11 includes an N-channel type TFT 12, a liquid crystal capacitor 13, and an auxiliary capacitor 14 (see FIG. 10).

The display control circuit 20 controls operations of the liquid crystal display device 1. More specifically, based on control signals provided from external (such as a horizontal synchronous signal HSYNC and a vertical synchronous signal VSYNC), the display control circuit 20 outputs control signals to the gate line drive circuit 30 and the source line drive circuit 40, and outputs display data DT provided from external to the source line drive circuit 40 at a suitable timing.

Based on the control signals output from the display control circuit 20, the gate line drive circuit 30 switches voltages at the gate lines G1 to Gm to a high level (a selection voltage: hereinafter, referred to as a gate high voltage Vgh) or a low level (a non-selection voltage: hereinafter, referred to as a gate low voltage Vgl). The gate voltage generation circuit 50 generates the gate high voltage Vgh and the gate low voltage Vgl, and supplies the generated voltages to the gate line drive circuit 30. One gate line among the gate lines G1 to Gm is selected by the action of the gate line drive circuit 30.

Based on the control signal SC and the display data DT output from the display control circuit 20, the source line drive circuit 40 controls voltages at the source lines S1 to Sn. By the action of the source line drive circuit 40, a voltage in accordance with the display data DT is written to the pixel circuit 11 connected to the gate line selected by the gate line drive circuit 30.

The liquid crystal display device 1 performs alternating-current driving for switching a polarity of a liquid crystal application voltage at every predetermined cycle. The liquid crystal display device 1 may perform frame inversion driving for switching a polarity of a liquid crystal application voltage on a frame period basis or may perform line inversion driving for switching the polarity of the liquid crystal application voltage on a line period basis. In order to perform the alternating-current driving, the source line drive circuit 40 switches between a positive polarity voltage and a negative polarity voltage, both in accordance with the display data DT, and applies the switched voltage to the source lines S1 to Sn. In the following, it is assumed that the source line drive circuit 40 switches between the positive polarity voltage and the negative polarity voltage at every one line period and at every one frame period, and applies the switched voltage to the source lines S1 to Sn.

The liquid crystal display device 1 has a function of switching a liquid crystal driving frequency. More specifically, the liquid crystal display device 1 receives a frequency selection signal FQS indicating a liquid crystal driving frequency, and the display control circuit 20 switches between an output timing of the control signal and an output timing of the display data DT in accordance with the frequency selection signal FQS. In the following, it is assumed that the liquid crystal display device 1 switches the liquid crystal driving frequency at four levels, that is, 60 Hz, 50 Hz, 40 Hz and 30 Hz. Moreover, it is assumed that the liquid crystal driving frequency is 60 Hz in a normal state.

In the liquid crystal display device 1, as will be described later, the gate low voltage Vgl after application of the negative polarity voltage changes in accordance with the liquid crystal driving frequency. Thus, a gate voltage amplitude in the negative polarity changes in accordance with the liquid crystal driving frequency. In the following, a gate low voltage after application of a positive polarity voltage is referred to as a gate low voltage Vglp in a positive polarity, a gate low voltage after application of a negative polarity voltage is referred to as a gate low voltage Vgln in a negative polarity, and differences between a gate high voltage Vgh and the respective gate low voltages are referred to as a gate voltage amplitude $Vg_{p\text{-}p}(p)$ in the positive polarity and a gate voltage amplitude $Vg_{p\text{-}p}(n)$ in the negative polarity.

The gate voltage generation circuit 50 includes a Vgh generation circuit 51, a Vgl generation circuit 52, a resistance division circuit 53, and a Vgln selection circuit 54. The Vgh generation circuit 51 generates a fixed gate high voltage Vgh, and the Vgl generation circuit 52 generates a fixed gate low voltage Vgl. The resistance division circuit 53 includes a plurality of resistors connected in series, and divides, using the resistors, the gate low voltage Vgl generated by the Vgl generation circuit 52 to output a plurality (four in this case) of voltages.

In accordance with the frequency selection signal FQS, the Vgln selection circuit 54 selects one voltage from the four voltages output from the resistance division circuit 53. As the liquid crystal driving frequency is low, the Vgln selection circuit 54 selects the low voltage. The voltage selected by the Vgln selection circuit 54 is supplied to the gate line drive circuit 30, as the gate low voltage Vgln in the negative polarity.

Moreover, the highest voltage among the four voltages output from the resistance division circuit 53 is supplied to the gate line drive circuit 30, as the gate low voltage Vglp in the positive polarity. The gate high voltage Vgh generated by the Vgh generation circuit 51 is also supplied to the gate line drive circuit 30. As described above, the gate voltage generation circuit 50 generates the fixed gate high voltage Vgh, the fixed gate low voltage Vglp in the positive polarity, and the gate low voltage Vgln in the negative polarity which changes in accordance with the liquid crystal driving frequency. A relation expressed by the following equation (2) is established among these voltages.

$$Vgln(30\ Hz)<Vgln(40\ Hz)<Vgln(50\ Hz)<Vgln(60\ Hz)=Vglp<Vgh \quad (2)$$

The display control circuit 20 outputs a gate clock GCK, a gate start pulse GSP, and a gate voltage selection signal GVS to the gate line drive circuit 30. The gate clock GCK is a clock signal having a cycle corresponding to one line period, and the gate start pulse GSP is a signal which turns into the high level only for one line period within one frame period. The gate voltage selection signal GVS is a signal indicating whether a liquid crystal application voltage being written has a positive polarity or a negative polarity. The gate voltage selection signal GVS turns into the high level when the liquid crystal application voltage has the positive polarity, and turns into the low level when the liquid crystal application voltage has the negative polarity. A polarity inversion signal REV indicating a polarity of a voltage to be applied to the source lines S1 to Sn may be used in place of the gate voltage selection signal GVS. In a case of performing driving for switching the common voltage Vcom at the two levels, that is, the high and low levels, a common voltage control signal COM indicating a level of the common voltage Vcom may be used.

The gate line drive circuit 30 includes a shift register 31 having m stages, m switch control circuits 32, and m switch circuits 33. The switch control circuit 32 and the switch circuit 33 are provided in correspondence with each stage of the shift register 31. The gate start pulse GSP is input to the first stage of the shift register 31, the gate clock GCK is input to each stage of the shift register 31, and the gate voltage selection signal GVS is input to each switch control circuit 32.

In accordance with the gate clock GCK, the shift register 31 sequentially shifts the gate start pulse GSP. Ina case where Xj represents an output from the j-th stage of the shift register 31, an output X1 turns into the high level at a first line period in one frame period, and an output X2 turns into the high level at a subsequent line period. Similarly, the output Xj sequentially turns into the high level at every one line period.

FIG. 2 is a circuit diagram of the switch control circuit 32 and the switch circuit 33. As shown in FIG. 2, the switch control circuit 32 includes a flip-flop 34 and two logic gates, and the switch circuit 33 includes three analog switches 35*a* to 35*c*. The flip-flop 34 captures the gate voltage selection signal GVS at falling of the output Xj. The flip-flop 34 is configured to capture the gate voltage selection signal GVS immediately before the falling of the output Xj. Thus, the gate voltage selection signal GVS at the time when the gate line Gj is selected is held on the flip-flop 34. Hereinafter, Yj represents an output from the flip-flop 34.

The voltage at the gate line Gj changes as follows in accordance with the outputs Xj and Yj (see FIG. 3). When the output Xj is at the high level, the analog switch 35*a* turns into an ON state, so that the gate high voltage Vgh is applied to the gate line Gj. When the output Xj is at the low level and the output Yj is at the high level, the analog switch 35*b* turns into the ON state, so that the gate low voltage Vglp in the positive polarity is applied to the gate line Gj. When both the outputs Xj and Yj are at the low level, the analog switch 35*c* turns into the ON state, so that the gate low voltage Vgln in the negative polarity is applied to the gate line Gj.

FIG. 4 is a signal waveform chart showing change of the voltage at the gate line. In FIG. 4, the gate voltage selection signal GVS turns into the high level in a first line period, turns into the low level in a second line period, and turns into the high level in a third line period. Moreover, the voltage at the gate line Gj turns into Vgh in the first line period, the voltage at the gate line Gj+1 turns into Vgh in the second line period, and the voltage at the gate line Gj+2 turns into Vgh in the third line period.

Upon change from the high level to the low level, the voltage at the gate line changes to Vglp or Vgln in accordance with the preceding gate voltage selection signal GVS. Specifically, the gate voltage selection signal GVS is at the high level when the voltage at the gate line Gj is Vgh; therefore, the voltage at the gate line Gj changes to Vglp. The same thing holds true for the voltage at the gate line Gj+2. On the other hand, the gate voltage selection signal GVS is at the low level when the voltage at the gate line Gj+1 is Vgh; therefore, the voltage at the gate line Gj+1 changes to Vgln. As described above, the voltage at the gate line changes to Vglp in the positive polarity and changes to Vgln in the negative polarity.

Based on the equation (2), a relation expressed by the following equation (3) is established between the gate voltage amplitude $Vg_{p\text{-}p}(p)(=Vgh-Vglp)$ in the positive polarity and the gate voltage amplitude $Vg_{p\text{-}p}(n)(=Vgh-Vgln)$ in the negative polarity.

$$Vg_{p\text{-}p}(n, 30\text{ Hz})>Vg_{p\text{-}p}(n, 40\text{ Hz})>Vg_{p\text{-}p}(n, 50\text{ Hz})>Vg_{p\text{-}p}(n, 60\text{ Hz})=Vg_{p\text{-}p}(p) \quad (3)$$

As described above, in the liquid crystal display device 1, the gate low voltage Vgl in the negative polarity becomes low as the liquid crystal driving frequency is low. Thus, the gate voltage amplitude $Vg_{p\text{-}p}(n)$ in the negative polarity becomes large as the liquid crystal driving frequency is low.

Figure 5:
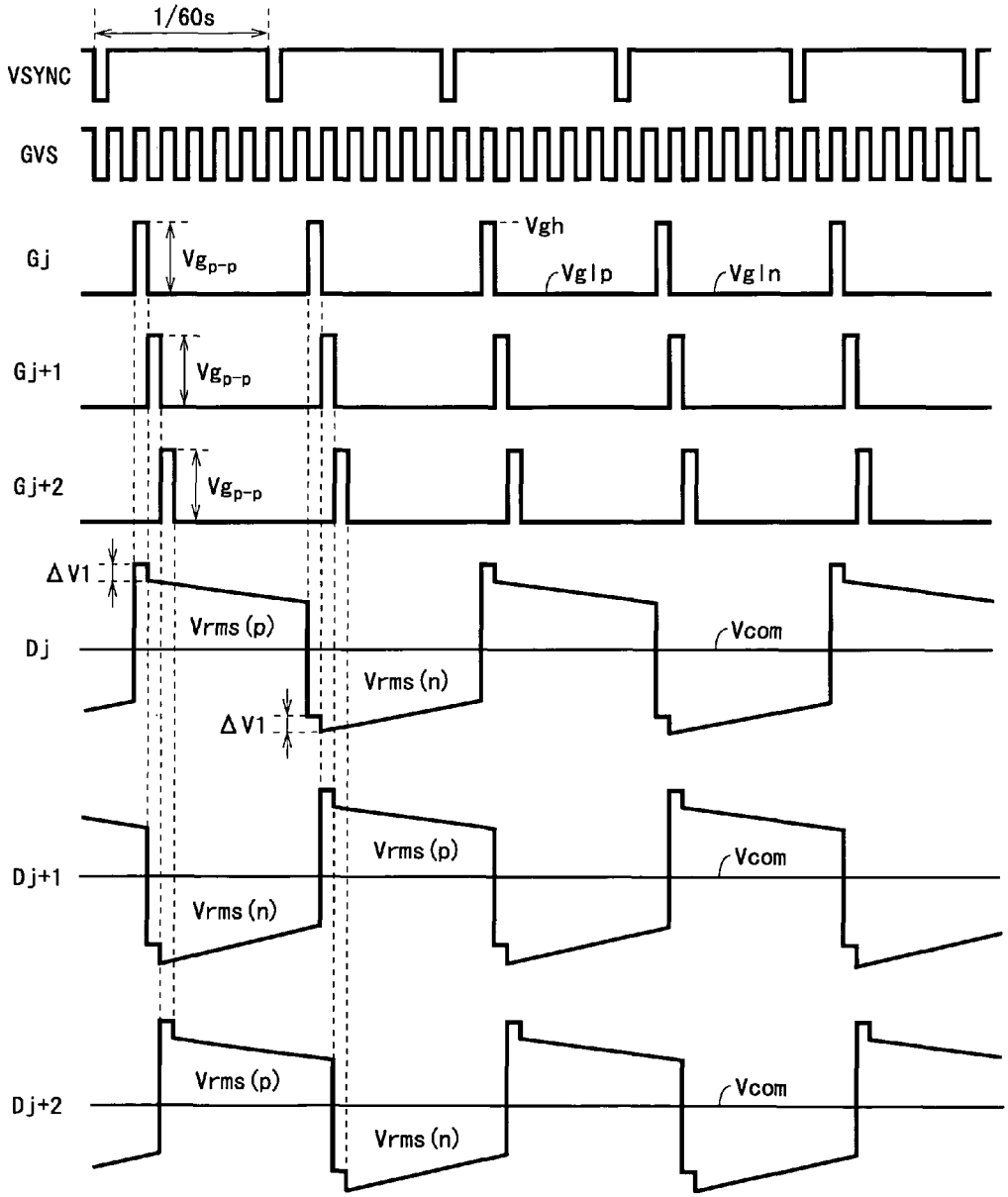
FIG. 5 is a signal waveform chart in a case where a liquid crystal driving frequency in the liquid crystal display device shown in FIG. 1 is 60 Hz.
Figure 6:
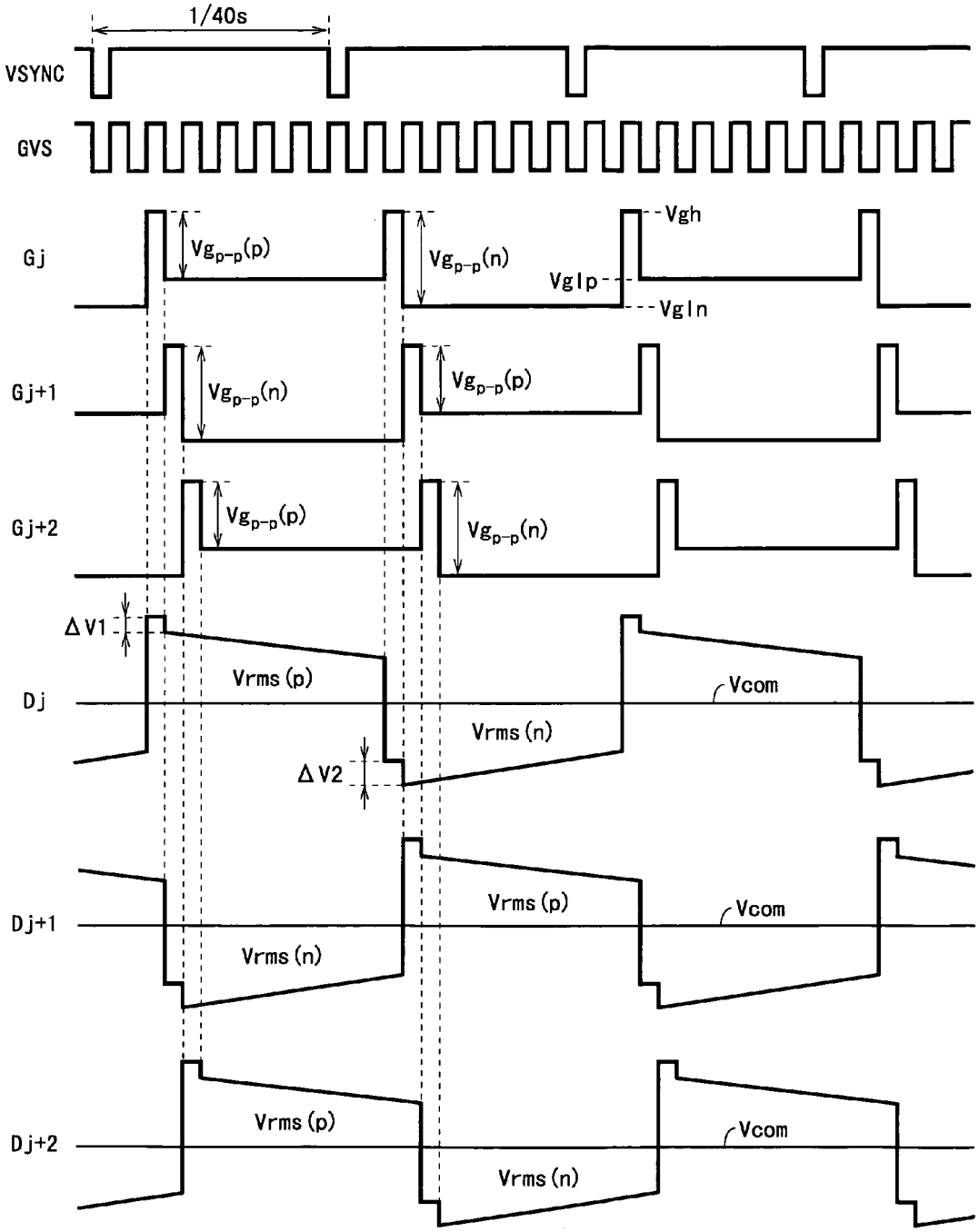
FIG. 6 is a signal waveform chart in a case where the liquid crystal driving frequency in the liquid crystal display device shown in FIG. 1 is 40 Hz.

FIG. 5 is a signal waveform chart in the case where the liquid crystal driving frequency is 60 Hz. FIG. 6 is a signal waveform chart in the case where the liquid crystal driving frequency is 40 Hz. In FIGS. 5 and 6, Gj represents a voltage at the gate line Gj (the gate voltage at the TFT 12 connected to the gate line Gj), and Dj represents a drain voltage at the TFT 12 connected to the gate line Gj. As shown in FIGS. 5 and 6, the drain voltage drops by the pull-in voltage when the gate voltage changes from Vgh to Vglp or Vgln, and gradually rises or drops during a period that the gate voltage is Vglp or Vgln. Herein, the pull-in voltage is given from the equation (1), and is proportional to the gate voltage amplitude $Vg_{p\text{-}p}$.

In the case where the liquid crystal driving frequency is 60 Hz (FIG. 5), the gate low voltage in the positive polarity is equal to the gate low voltage in the negative polarity (Vglp=Vgln). Therefore, the gate voltage amplitude in the positive polarity becomes equal to the gate voltage amplitude in the negative polarity ($Vg_{p\text{-}p}(p)=Vg_{p\text{-}p}(n)$), and the pull-in voltage in the positive polarity becomes equal to the pull-in voltage in the negative polarity (each designated by ΔV1 in FIG. 5). The common voltage Vcom is adjusted such that the effective voltage Vrms(p) in the positive polarity becomes equal to the effective voltage Vrms(n) in the negative polarity in the case where the liquid crystal driving frequency is 60 Hz. After the adjustment, the common voltage Vcom is fixed.

In contrast to this, in the case where the liquid crystal driving frequency is 40 Hz (FIG. 6), the gate low voltage in the negative polarity is lower than the gate low voltage in the positive polarity (Vglp>Vgln). Therefore, the gate voltage amplitude in the negative polarity becomes larger than the gate voltage amplitude in the positive polarity ($Vg_{p\text{-}p}(p)<Vg_{p\text{-}p}(n)$), and the pull-in voltage ΔV2 in the negative polarity becomes larger than the pull-in voltage ΔV1 in the positive polarity (ΔV1<ΔV2).

Figure 7A:
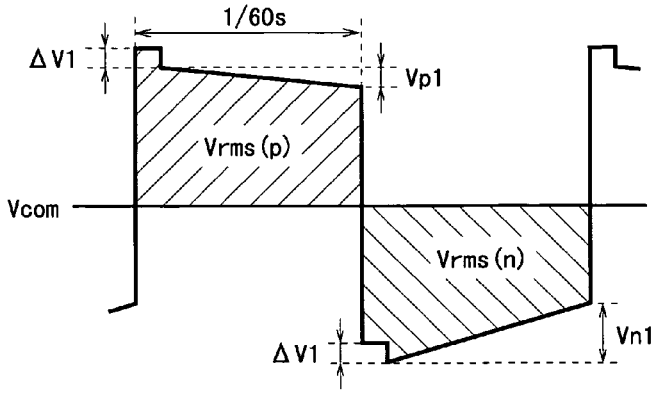
FIG. 7A is a signal waveform chart in the case where the liquid crystal driving frequency in the liquid crystal display device shown in FIG. 1 is 60 Hz.

Hereinafter, description will be given of effects of the liquid crystal display device 1 according to this embodiment, in comparison with a conventional liquid crystal display device in which a gate voltage amplitude $Vg_{p\text{-}p}$ is fixed. In the liquid crystal display device 1, when the liquid crystal driving frequency is 60 Hz, the drain voltage at the TFT 12 changes as shown in FIG. 7A. The drain voltage drops by ΔV1 in each of the positive polarity and the negative polarity when the TFT 12 turns into an OFF state. During a period that the TFT 12 is in the OFF state (hereinafter, referred to as a TFT off period), the drain voltage drops by Vp1 in the positive polarity and rises by Vn1 in the negative polarity.

Figure 8:
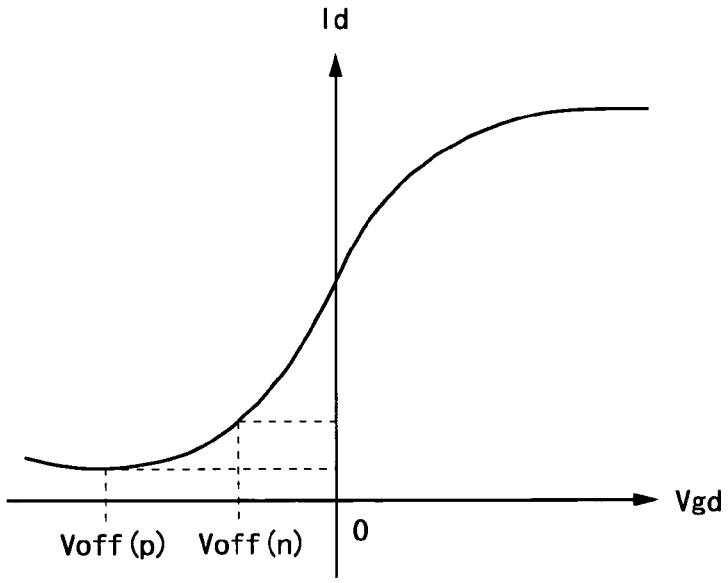
FIG. 8 is a current characteristic diagram of a TFT of the liquid crystal display device shown in FIG. 1.

The TFT 12 has a current characteristic shown in FIG. 8. As shown in FIG. 8, a drain current Id becomes small as the gate-drain voltage Vgd is low, but does not become zero even when the voltage Vgd has a negative value. When the gate voltage is Vgl, the gate-drain voltage in the positive polarity is lower than the gate-drain voltage in the negative polarity (Voff(p)<Voff(n) in FIG. 8); therefore, a leak current in the positive polarity becomes smaller than a leak current in the negative polarity. Accordingly, a drop rate in the positive polarity becomes slower than a rise rate in the negative polarity with regard to the drain voltage during the TFT off period, and a drop amount Vp1 becomes smaller than a rise amount Vn1 with regard to the drain voltage during the TFT off period (Vp1<Vn1). That is, the voltage holding ratio of the liquid crystal element in the negative polarity is lower than the voltage holding ratio of the liquid crystal element in the positive polarity. Even when the drain voltage changes as described above, the common voltage Vcom is adjusted such that the effective voltage Vrms(p) in the positive polarity becomes equal to the effective voltage Vrms(n) in the negative polarity. Thus, it is possible to prevent flicker.

Figure 7B:
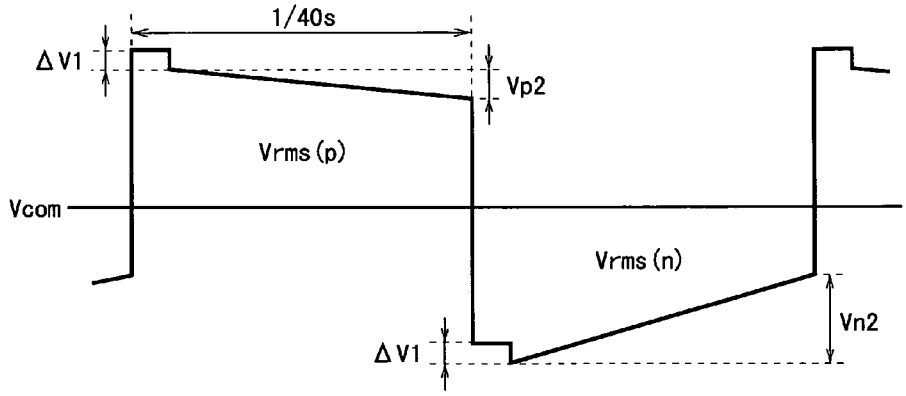
FIG. 7B is a signal waveform chart in a case where a liquid crystal driving frequency in a conventional liquid crystal display device is 40 Hz.

Also in the conventional liquid crystal display device, when a liquid crystal driving frequency is 60 Hz, flicker can be prevented by the method described above. In the conventional liquid crystal display device, when the liquid crystal driving frequency is 40 Hz, a drain voltage at a TFT changes as shown in FIG. 7B. A rise rate and a drop rate of the drain voltage during a TFT off period do not depend on the liquid crystal driving frequency; therefore, a drop amount Vp2 and a rise amount Vn2 of the drain voltage during the TFT off period increase in accordance with a degree of extension of a frame period. For example, in a case where the drain voltage rises or drops at a constant rate, Vp2 becomes about 1.5 times as large as Vp1 whereas Vn2 becomes about 1.5 times as large as Vn1.

However, a common voltage Vcom is adjusted with respect to the case where the liquid crystal driving frequency is 60 Hz. Consequently, in a case where the drop rate in a positive polarity is slower than the rise rate in a negative polarity with regard to the drain voltage during the TFT off period, if the liquid crystal driving frequency is 40 Hz, an effective voltage Vrms(p) in the positive polarity becomes higher than an effective voltage Vrms(n) in the negative polarity. In the conventional liquid crystal display device, accordingly, when the liquid crystal driving frequency is 40 Hz, flicker occurs at a screen. In order to prevent this flicker, the common voltage Vcom needs to be changed such that the effective voltage Vrms(p) in the positive polarity becomes equal to the effective voltage Vrms(n) in the negative polarity.

Figure 7C:
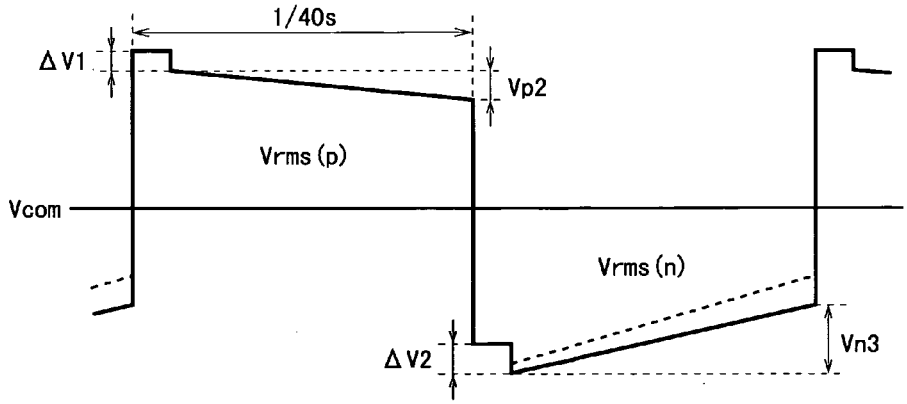
FIG. 7C is a signal waveform chart in the case where the liquid crystal driving frequency in the liquid crystal display device shown in FIG. 1 is 40 Hz.

In contrast to this, in the liquid crystal display device 1, when the liquid crystal driving frequency is 40 Hz, the drain voltage at the TFT 12 changes as shown in FIG. 7C. In the liquid crystal display device 1, in order to eliminate a difference in effective voltage due to a difference between the voltage holding ratio in the positive polarity and the voltage holding ratio in the negative polarity, when the liquid crystal driving frequency is 40 Hz, the gate low voltage Vgln in the negative polarity is set to be low, so that the pull-in voltage ΔV2 in the negative polarity is set to be higher than the pull-in voltage ΔV1 in the positive polarity. Specifically, the gate low voltage Vgln (40 Hz) in the negative polarity at the time when the liquid crystal driving frequency is 40 Hz is determined such that the effective voltage Vrms(n) in the negative polarity becomes equal to the effective voltage Vrms(p) in the positive polarity at the time when the liquid crystal driving frequency is 40 Hz. When the liquid crystal driving frequency is 40 Hz, the gate voltage generation circuit 50 outputs the gate low voltage Vgln (40 Hz) in the negative polarity, the gate low voltage being determined as described above. Accordingly, the liquid crystal display device 1 allows prevention of flicker without changing the common voltage Vcom even when the liquid crystal driving frequency is 40 Hz.

Figure 9:
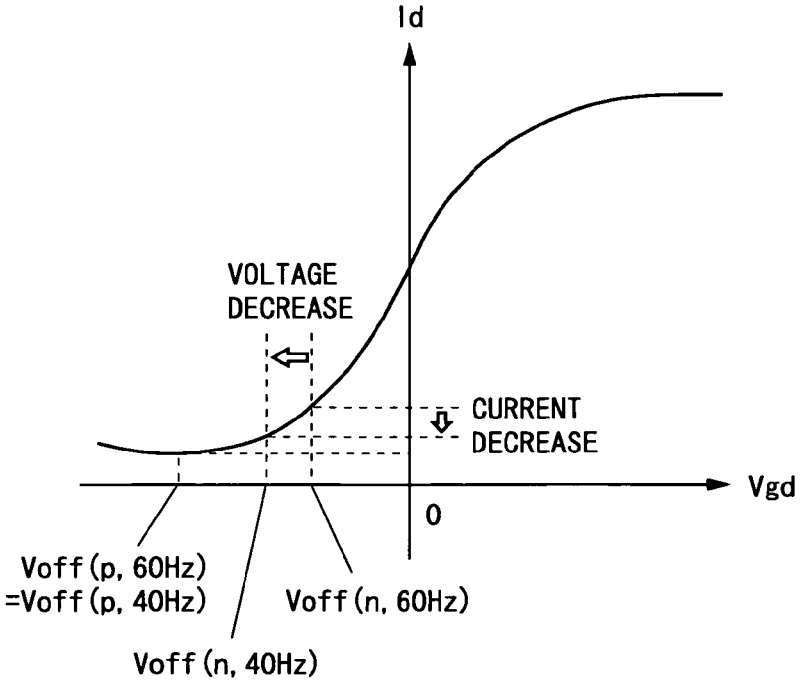
FIG. 9 is a diagram showing reduction of a leak current in the liquid crystal display device shown in FIG. 1.

In the liquid crystal display device 1, moreover, the gate low voltage in the negative polarity at the time when the liquid crystal driving frequency is 40 Hz is lower than the gate low voltage in the negative polarity at the time when the liquid crystal driving frequency is 60 Hz (Vgln (40 Hz)<Vgln (60 Hz)). As shown in FIG. 9, for this reason, the gate-drain voltage in the negative polarity at the time when the liquid crystal driving frequency is 40 Hz becomes lower than the gate-drain voltage in the negative polarity at the time when the liquid crystal driving frequency is 60 Hz (Voff(n, 40 Hz)<Voff(n, 60 Hz) in FIG. 9), so that the leak current becomes small. Accordingly, when the liquid crystal driving frequency is 40 Hz, a rise amount Vn3 of the drain voltage in the negative polarity during the TFT off period decreases as compared with the conventional rise amount Vn2 (Vn2>Vn3). Accordingly, it is possible to improve the voltage holding ratio of the liquid crystal element in the negative polarity during the TFT off period.

In the same manner, the gate low voltage Vgln (30 Hz) in the negative polarity at the time when the liquid crystal driving frequency is 30 Hz is determined so that the effective voltage Vrms(p) in the positive polarity becomes equal to the effective voltage Vrms(n) in the negative polarity at the time when the liquid crystal driving frequency is 30 Hz. The gate low voltage Vgln (50 Hz) in the negative polarity at the time when the liquid crystal driving frequency is 50 Hz is determined so that the effective voltage Vrms(p) in the positive polarity becomes equal to the effective voltage Vrms(n) in the negative polarity at the time when the liquid crystal driving frequency is 50 Hz. Thus, it is possible to prevent flicker and to improve an off characteristic of the TFT 12 in the negative polarity even when the liquid crystal driving frequency is 30 Hz or 50 Hz.

As described above, the liquid crystal display device 1 according to this embodiment changes the gate voltage amplitude $Vg_{p\text{-}p}(n)$ in the negative polarity in accordance with the liquid crystal driving frequency to set the effective value of the liquid crystal application voltage in the positive polarity to be equal to the effective value of the liquid crystal application voltage in the negative polarity irrespective of the liquid crystal driving frequency. Thus, it is possible to prevent flicker from occurring when the liquid crystal driving frequency is switched. Moreover, it is possible to prevent flicker from occurring when the liquid crystal driving frequency is switched, with the common voltage Vcom fixed. Further, as the liquid crystal driving frequency is low, the gate low voltage Vgln in the negative polarity is set to be low. Thus, it is possible to reduce the leak current from the TFT 12 and to improve the voltage holding ratio of the liquid crystal element.

With regard to the liquid crystal display device 1, the following modification examples may be configured. In a liquid crystal display device that performs alternating-current driving, at least one of a difference between a selection voltage upon application of a positive polarity voltage (a first voltage) and a non-selection voltage after application of the positive polarity voltage (a second voltage) and a difference between a selection voltage upon application of a negative polarity voltage (a third voltage) and a non-selection voltage after application of the negative polarity voltage (a fourth voltage) may change in accordance with a liquid crystal driving frequency. In order to achieve this configuration, any one voltage among the four voltages or a plurality of voltages among the four voltages may change in accordance with the liquid crystal driving frequency.

In a case where the selection voltage is higher than the non-selection voltage, the difference between the third voltage and the fourth voltage may become large as the liquid crystal frequency is low. In order to achieve this configuration, the fourth voltage may become low or the third voltage may become high as the liquid crystal driving frequency is low. Alternatively, the difference between the first voltage and the second voltage may become large as the liquid crystal driving frequency is low. In order to achieve this configuration, the second voltage may become low or the first voltage may become high as the liquid crystal driving frequency is low.

In the liquid crystal display device 1, specifically, the gate low voltage Vgln in the negative polarity becomes low as the liquid crystal driving frequency is low. Thus, the gate voltage amplitude $Vg_{p-p}(n)$ in the negative polarity becomes high as the liquid crystal driving frequency is low. Instead of this configuration, the gate high voltage Vghn in the negative polarity may become high as the liquid crystal driving frequency is low. Alternatively, the gate low voltage Vglp in the positive polarity may become low or the gate high voltage Vghp in the positive polarity may become high as the liquid crystal driving frequency is low. Thus, the gate voltage amplitude $Vg_{p-p}(p)$ in the positive polarity may become large as the liquid crystal driving frequency is low.

Moreover, the gate high voltage Vghn in the negative polarity and the gate low voltage Vgln in the negative polarity may change in accordance with the liquid crystal driving frequency. Thus, the gate voltage amplitude $Vg_{p-p}(n)$ in the negative polarity may become large as the liquid crystal driving frequency is low. Further, the gate high voltage Vghp in the positive polarity and the gate low voltage Vglp in the positive polarity may change in accordance with the liquid crystal driving frequency. Thus, the gate voltage amplitude $Vg_{p-p}(p)$ in the positive polarity may become large as the liquid crystal driving frequency is low. In addition, a plurality of voltages among the voltages Vghp, Vghn, Vglp and Vgln may change in accordance with the liquid crystal driving frequency. Thus, both the gate voltage amplitude $Vg_{p-p}(p)$ in the positive polarity and the gate voltage amplitude $Vg_{p-p}(n)$ in the negative polarity may change in accordance with the liquid crystal driving frequency.

As in the liquid crystal display device 1, the liquid crystal display device according to these modification examples allows prevention of flicker occurring when the liquid crystal driving frequency is switched. In particular, one voltage is changed in accordance with the liquid crystal driving frequency. Thus, it is possible to prevent flicker from occurring when the liquid crystal driving frequency is switched, with the simple circuitry. Moreover, a plurality of voltages are changed in accordance with the liquid crystal driving frequency. Thus, it is possible to set the effective value of the liquid crystal application voltage in the positive polarity to be equal to the effective value of the liquid crystal application voltage in the negative polarity with higher accuracy, and to more suitably prevent flicker from occurring when the liquid crystal driving frequency is switched.

The liquid crystal display device may switch the liquid crystal driving frequency at levels other than four levels or may continuously switch the liquid crystal driving frequency. In place of the Vgln selection circuit 54, moreover, the liquid crystal display device may include a gate voltage selection circuit for selecting a voltage to be applied to a gate line based on a signal indicating a liquid crystal driving frequency, for example, a dot clock given to the liquid crystal display device. The liquid crystal display device may perform driving for switching the common voltage Vcom at two levels, that is, the high and low levels or may perform driving for switching the common voltage Vcom at three or more levels. Moreover, the common voltage Vcom in the liquid crystal display device may be adjusted with respect to a liquid crystal driving frequency other than the normal state (e.g., 30 Hz).

The liquid crystal display device may perform dot inversion driving for switching a polarity of a liquid crystal application voltage on a dot basis. In the liquid crystal display device that performs the dot inversion driving, the positive polarity voltage and the negative polarity voltage are simultaneously applied to the source line. Therefore, the gate high voltage Vgh and the gate low voltage Vgl can not be separated in the positive polarity and the negative polarity, so that the relations of Vghp=Vghn and Vglp=Vgln are always satisfied. Also in this case, when both the gate high voltage Vghp in the positive polarity and the gate high voltage Vghn in the negative polarity change in accordance with the liquid crystal driving frequency, when both the gate low voltage Vglp in the positive polarity and the gate low voltage Vgln in the negative polarity change in accordance with the liquid crystal driving frequency, or when the voltages Vghp, Vghn, Vglp and Vgln change in accordance with the liquid crystal driving frequency while satisfying the relations of Vghp=Vghn and Vglp=Vgln, flicker can be prevented from occurring when the liquid crystal driving frequency is switched, as in the liquid crystal display device According to the liquid crystal display device described above, since no flicker occurs at the screen even when the liquid crystal driving frequency is switched, it is possible to display the screen with low power consumption while keeping display quality favorably. Moreover, since a direct-current voltage is prevented from being applied to the liquid crystal, it is possible to prevent the liquid crystal from being degraded.

INDUSTRIAL APPLICABILITY

The liquid crystal display device of the present invention has a feature in that no flicker occurs at a screen even when a liquid crystal driving frequency is switched, and therefore is applicable to various electronic appliances such as a mobile telephone and a handheld computer.

The invention claimed is:

1. A liquid crystal display device having a function of switching a liquid crystal driving frequency, comprising:

a plurality of pixel circuits each including a liquid crystal element, the pixel circuits being arranged at intersections of a plurality of scanning signal lines and a plurality of data signal lines;

a scanning signal line drive circuit configured to switch between applying one of a selection voltage and a non-selection voltage to each of the plurality of scanning signal lines, the non-selection voltage being lower than the selection voltage; and a data signal line drive circuit configured to switch between applying a positive polarity voltage and a negative polarity voltage, both in accordance with display data, to each of the plurality of data signal lines, wherein the scanning signal line drive circuit is configured such that, for each of the plurality of scanning signal lines, at least one of a first difference and a second difference becomes large as a driving frequency of the liquid crystal element is low, the first difference being a difference between a first voltage corresponding to the selection voltage applied by the scanning signal line drive circuit to the scanning signal line upon the application of the positive polarity voltage and a second voltage corresponding to the non-selection voltage applied by the scanning signal line drive circuit to the scanning signal line after the application of the positive polarity voltage, the second difference being a difference between a third voltage corresponding to the selection voltage applied by the scanning signal line drive circuit to the scanning signal line upon the application of the negative polarity voltage and a fourth voltage corresponding to the non-selection voltage applied by the scanning signal line drive circuit to the scanning signal line after the application of the negative polarity voltage.

2. The liquid crystal display device according to claim 1, wherein any one voltage among the first to fourth voltages changes in accordance with the driving frequency.

3. The liquid crystal display device according to claim 1, wherein a plurality of voltages among the first to fourth voltages change in accordance with the driving frequency.

4. The liquid crystal display device according to claim 1, wherein the third voltage is higher than the fourth voltage, and the difference between the third voltage and the fourth voltage becomes large as the driving frequency is low.

5. The liquid crystal display device according to claim 4, wherein the fourth voltage becomes low as the driving frequency is low.

6. The liquid crystal display device according to claim 4, wherein the third voltage becomes high as the driving frequency is low.

7. The liquid crystal display device according to claim 1, wherein the first voltage is higher than the second voltage, and the difference between the first voltage and the second voltage becomes large as the driving frequency is low.

8. The liquid crystal display device according to claim 7, wherein the second voltage becomes low as the driving frequency is low.

9. The liquid crystal display device according to claim 7, wherein the first voltage becomes high as the driving frequency is low.

10. The liquid crystal display device according to claim 1, further comprising a voltage generation circuit configured to generate the selection voltage and the non-selection voltage to supply the generated voltage to the scanning signal line drive circuit, wherein the voltage generation circuit separately supplies the first voltage and the third voltage, and/or the second voltage and the fourth voltage to the scanning signal line drive circuit.

11. A method for driving a liquid crystal display device including a plurality of pixel circuits each including a liquid crystal element, the pixel circuits being arranged at intersections of a plurality of scanning signal lines and a plurality of data signal lines, comprising the steps of:

switching between applying one of a selection voltage and a non-selection voltage to each of the plurality of scanning signal lines, the non-selection voltage being lower than the selection voltage; and switching between applying a positive polarity voltage and a negative polarity voltage, both in accordance with display data, to each of the plurality of data signal lines, wherein in the switching between applying one of the selection voltage and the non-selection voltage, for each of the plurality of scanning signal lines, at least one of a first difference and a second difference becomes large as a driving frequency of the liquid crystal element is low, the first difference being a difference between a first voltage corresponding to the selection voltage applied to the scanning signal line upon the application of the positive polarity voltage and a second voltage corresponding to the non-selection voltage applied to the scanning signal line after the application of the positive polarity voltage, the second difference being a difference between a third voltage corresponding to the selection voltage applied to the scanning signal line upon the application of the negative polarity voltage and a fourth voltage corresponding to the non-selection voltage applied to the scanning signal line after the application of the negative polarity voltage.

* * * * *